United States Patent [19]

Tillon

[11] 4,034,579

[45] July 12, 1977

[54] CONTINUOUS PRODUCTION OF FRINGED TEXTILE ARTICLES

[75] Inventor: Georges Tillon, Saint-Etienne-Loire, France

[73] Assignee: Etablissements Giraudon S.A., Saint-Etienne-Loire, France

[21] Appl. No.: 612,177

[22] Filed: Sept. 10, 1975

[30] Foreign Application Priority Data

Sept. 13, 1974 France ..... 74.31730
July 31, 1975 France ..... 75.25701

[51] Int. Cl.[2] ..... D04B 23/14
[52] U.S. Cl. ..... 66/85 R; 66/193
[58] Field of Search ..... 66/85 R, 85 A, 61, 83, 66/84, 193

[56] References Cited

U.S. PATENT DOCUMENTS 3,653,230 4/1972 Tosco ..... 66/85 R

FOREIGN PATENT DOCUMENTS 494,446 7/1950 Belgium ..... 66/85
471,041 2/1929 Germany ..... 66/85

*Primary Examiner*—Henry S. Jaudon

[57] ABSTRACT

An apparatus for producing fringed braid comprising a reciprocable weft guide for meshing weft yarn with warp to form a braid with projecting loops of the yarn. A sliver guide is reciprocable to form loops of fringe sliver. One guide is displaceable from one side to the opposite side of the other guide whereby the yarn and sliver loops are formed interlooped. Sliver loop halves are interconnected by warp threads. A similar apparatus has an additional weft yarn guide, two braids being simultaneously produced, with projecting yarn loops of each being interlooped with loops of a single sliver.

17 Claims, 15 Drawing Figures

CONTINUOUS PRODUCTION OF FRINGED TEXTILE ARTICLES

BACKGROUND OF THE INVENTION

Field of the Invention

This invention relates to fringed textile articles, particularly passementerie, comprising a braid formed at intervals with weftwise projecting loops holding a fringe.

SUMMARY OF THE INVENTION

According to one aspect of the present invention, there is provided a method for continuous production of a fringed textile article comprised of a braid formed at intervals with weftwise projecting loops holding a fringe, comprising knitting a continuous weft yarn with warp to form said braid, displacing a weft yarn guide weftwise from said braid to form a weftwise projecting part-loop of said continuous weft yarn, displacing towards said braid a fringe sliver guide to form a weftwise part-loop of a fringe sliver, displacing the guides relative to each other to displace one of the guides from one side of the other guide to the opposite side of said other guide to interloop the part-loops, returning said weft yarn guide weftwise to said braid to complete a projecting loop of said continuous weft yarn, resuming said knitting, returning said fringe sliver guide weftwise away from said braid to complete a loop of said fringe sliver, and interconnecting the part-loops of said fringe sliver with first and second warp threads spaced apart weftwise.

According to another aspect of the present invention, there is provided apparatus for the continuous production of a fringed textile article comprised of a braid formed at intervals with weftwise projecting loops holding tassels forming a fringe, comprising a weft yarn guide for guiding a continuous weft yarn which is knitted with warp to form said braid, means for reciprocating said weft yarn guide weftwise to form said weftwise projecting loops, a fringe sliver guide for guiding a fringe sliver, means for reciprocating said fringe sliver guide weftwise to form weftwise loops of said fringe sliver, displacing means for displacing the guides relative to each other to displace one of the guides from one side of the other guide to the opposite side of said other guide to produce said weftwise projecting loops and said loops of said fringe sliver in a condition with said weftwise projecting loops interlooped with said loops of said fringe sliver, and means for interconnecting the halves of said loops of said fringe sliver with first and second warp threads spaced apart weftwise.

BRIEF DESCRIPTION OF THE DRAWINGS

In order that the invention may be clearly understood and readily carried into effect, reference will now be made, by way of example, to the accompanying diagrammatic drawings, in which.

DESCRIPTION OF THE PREFERRED EMBODIMENTS

Figure 1:
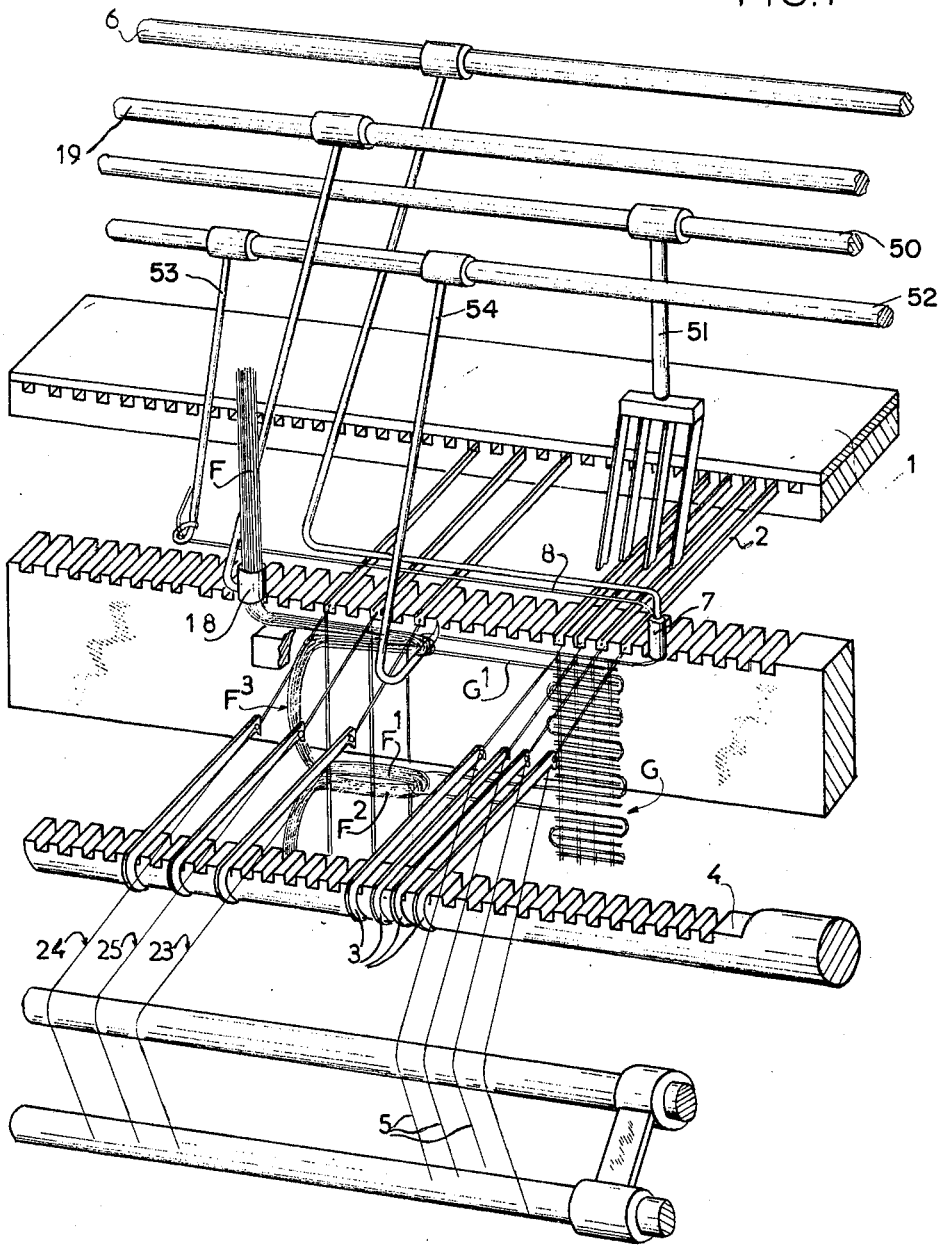
FIG. 1 shows a perspective view of parts of a warp knitting machine.
Figure 2:
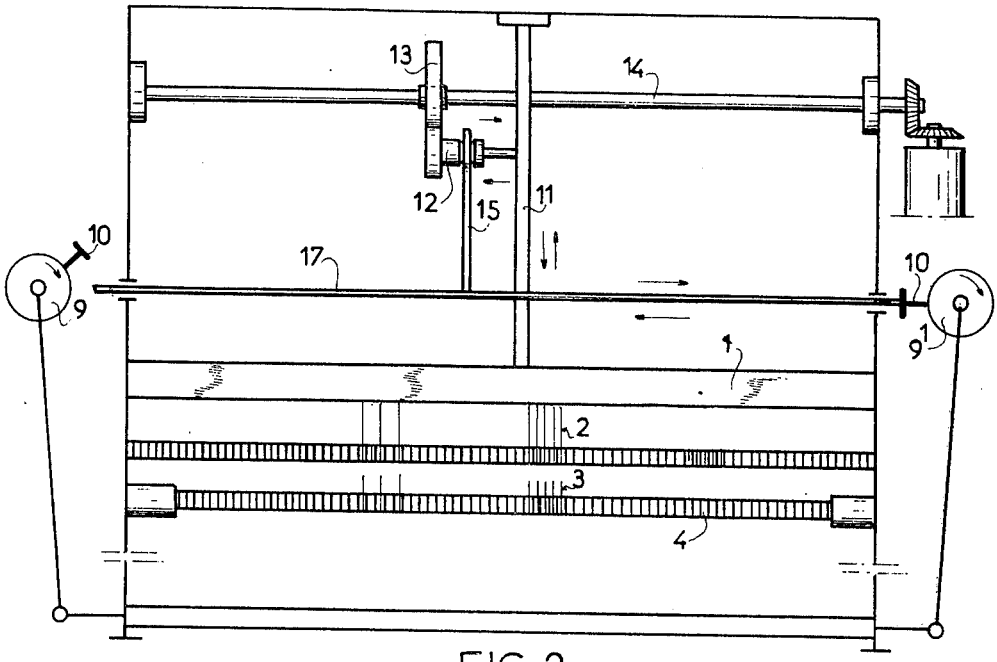
FIG. 2 shows a view of apparatus for disengaging a needle bar of the warp knitting machine of FIG. 1.
Figure 3:
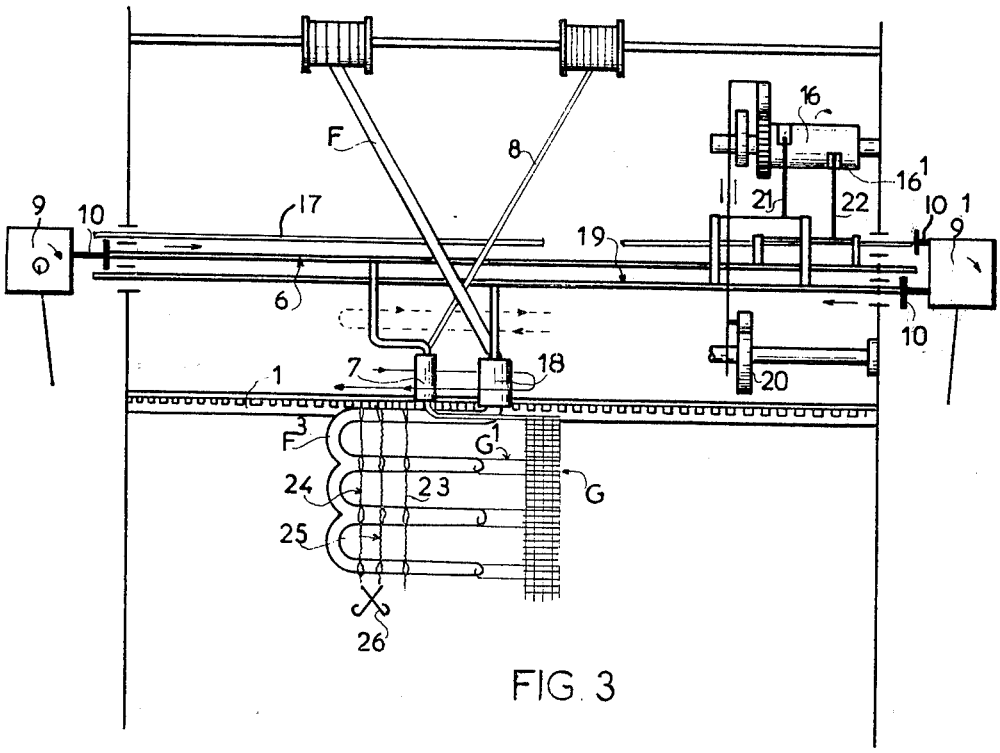
FIG. 3 shows a view illustrating the movement of weft yarn guides of the warp knitting machine of FIG. 1.

Referring to FIG. 1, a warp knitting machine includes a horizontal needle bar 1 which is reciprocable so that needles 2 held by the bar 1 are presented to corresponding hooks 3 held by a hook bar 4 and engaged by a group of warp threads 5. As is conventional the hook bar 4 is axially reciprocated and rotated and the bar 1 is reciprocated in a direction perpendicular to its length.

A weft yarn guide 7 is carried by a carrier rod 6 to receive continuous weft yarn 8, and by weftwise reciprocation of the yard guide 7 and rocking thereof, which movements are respectively controlled by associated drums 9,9$^1$, provided with dogs 10, and by a cam 16 having peripheral projections 16$^1$, in combination with the reciprocation of the needle bar 1, there is knitted a braid G having weftwise projection loops, for the formation of which loops temporary travel variation of the rod 6, and consequently of the yarn guide 7, are provided.

A further rod 50 of the warp knitting machine carrying a guide 51 for further weft yarn is rendered idle in the machine and does not take part in the formation of the article. The machine also has a rod 52 carrying a guide 53 for weft yarn 8 proceeding to yarn guide 7 and a hook 54 for engaging sliver F to be discussed later. The needles 2 and the guides 3 are constructed and perform, in known manner the necessary rotations and lateral displacements to cause the needles 2 to knit the warp threads extending through the guides and to interknit the threads with the weft yarn.

The reciprocatory movement of the needle bar 1 is effected by means of a control rod 11 carrying a followerwheel 12 which co-operates with a rotary cam 13 mounted on a drive shaft 14. The wheel 12 is moved weftwise for disengagment from the rotary cam 13, by means of a forked rod 15 fast with a disengaging bar 17 longitudinally reciprocable by the dogs 10 of the drums 9,9$^1$, reciprocation of the rod 15 causing the wheel 12 to move axially.

This arrangement makes it possible, by disengagement of the wheel 12 from the cam 13, to stop temporarily the driving of the needle bar 1, and consequently to stop the weaving of the braid G during the formation of a loop G1 of the weft yarn, when the yarn guide 7 is in an extreme distant position in relation to the braid G.

A fringe sliver guide 18, carried by a carrier rod 19 disposed forwardly of the rod 6 and controlled for lengthwise reciprocation by the drums 9,9$^1$, receives threads F which constitute a rope-like fringe sliver.

It should be noted that the sliver guide 18 is displaced on the one hand weftwise, and on the other hand angularly, at the end of travel, by means of a ratchet device controlled by cam means 20 for intermittent driving of the cam 16, said cam 16 having peripheral projection 16$^1$ against which there bear pivotable levers 21, 22 connected by straps respectively to the rods 19 and 6 thereby to periodically produce rocking of said rods in correspondence with intermittent drive of the cam.

There will now be described various phases in the operation of the warp knitting machine.

Figure 4:
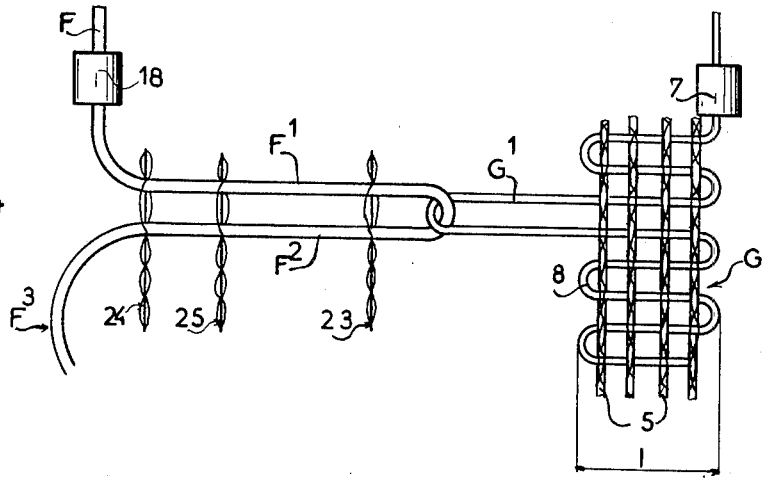
FIG. 4 shows a view illustrating the knitting of a braid on the warp knitting machine of FIG. 1, the weft yarn of the braid being interlooped with a fringe sliver.

In a first phase (see FIG. 4) the braid G is knitted (in usual manner) between the loops G1, which are formed at a spacing A (see FIG. 7), the weft yarn 8 being given a weftwise movement by the yarn guide 7 in combination with the reciprocating movement of the needles 2, and in accordance with the desired width of the braid G, with the formation of closed-up or scalloped braid edges.

This knitting operation is accompanied, by means of other of the needles 2 and hooks 3, by the knitting of a small chain or warp of elastic threads 23, spaced from the braid G, with the fringe sliver F, as is further described below. In the same way, two other warp threads 24 and 25, which are non-elastic, are knitted with the fringe sliver F, as is also further described below.

In a second phase of operation of the warp knitting machine, comprising the formation of a part-loop G1 (see FIG. 5), the yarn guide 7, acted upon by the drums 9,9$^1$, is displaced over a considerable length L, corresponding to the length of a loop G$^1$, so as thus to bring the weft yarn 8 into the extreme position, and is stopped, while at this instant the needle bar 1 is also stopped by disengagement of the wheel 12 from the cam 13. Consequently the knitting of the braid G, and of the warp threads 23, 24 and 25, is interrupted.

Figure 5:
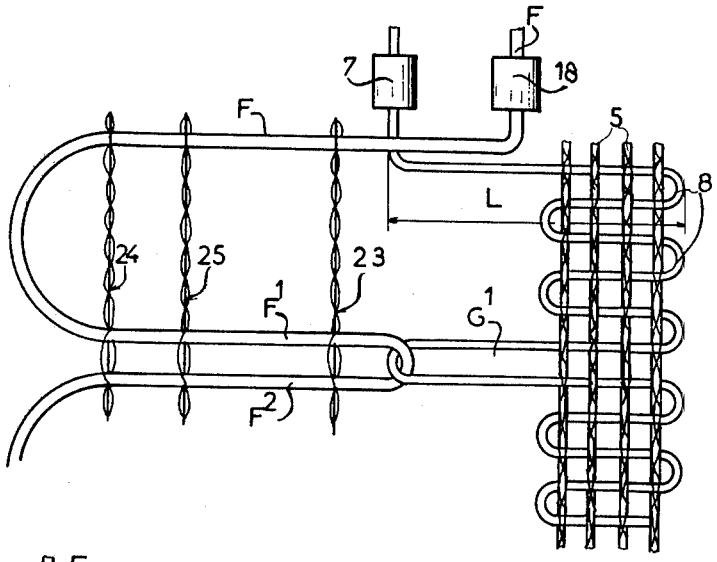
FIG. 5 shows a view similar to that of FIG. 4 illustrating a phase in the formation of a fringe on the braid.
Figure 6:
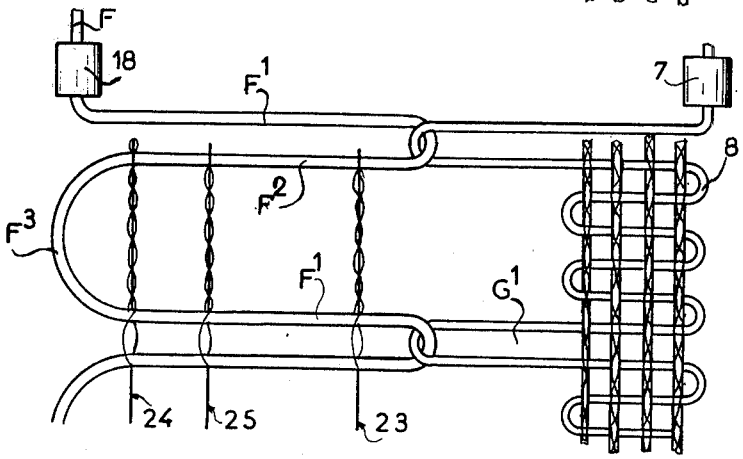
FIG. 6 shows a view similar to that of FIGS. 4 and 5 but illustrating a subsequent phase in the formation of the fringe.

The sliver guide 18 receiving the fringe sliver F is then moved, under action of the drum 9 acting on the rod 19, longitudinally so as to pass the yarn guide 7, at the front side thereof, as far as a projecting position shown in FIG. 5.

At the end of the weftwise movement of the shuttle 18, the rod 19 is acted upon by one of the projections 16$^1$ of the cam 16 by means of the lever 22 to cause the sliver guide 18 to rock rearwards about the rod 19. Subsequent weftwise return travel of the rod 19 to the initial position thereof, under the action of the opposite drum 9$^1$, thus causes the sliver F to be formed into a loop, part-loops of which are designated F$^1$ and F$^2$.

In a third phase of operation of the warp knitting machine and after the stopping of the sliver guide 18, the wheel 12 is re-engaged with the cam 13 to once again bring into operation the needle bar 1, while the guide 7 for the weft yarn 8 is controlled by the drums 9 and 9$^1$. Consequently the shuttle 7 is displaced towards the braid G to complete the loop G$^1$ interlooped with the sliver F. At the same time the elastic warp threads 23 are knitted to enclose and tie the two part-loops F$^1$ and F$^2$ of the sliver F in the region of the loop G1. Similarly, the two warp threads 24 and 25 of non-elastic material, which also surround the two part-loops F$^1$ and F$^2$, but which are disposed further from the loop G$^1$ than is the warp thread 23, are knitted.

After this third phase, the knitting of the braid G is resumed as described hereinbefore, and these operations are repeated at each loop G$^1$ with alternation of the direction of rocking of the guide 18, which passes the guide 7 at the front side, as just described, or at the rear side in the case of the next following loop G$^1$.

Figure 7:
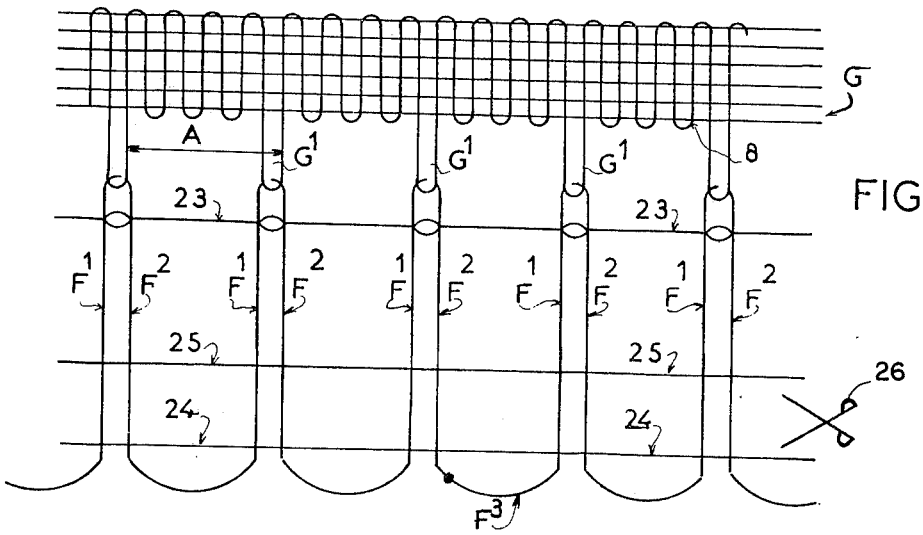
FIG. 7 shows a view of the braid and the fringe sliver.
Figure 9:
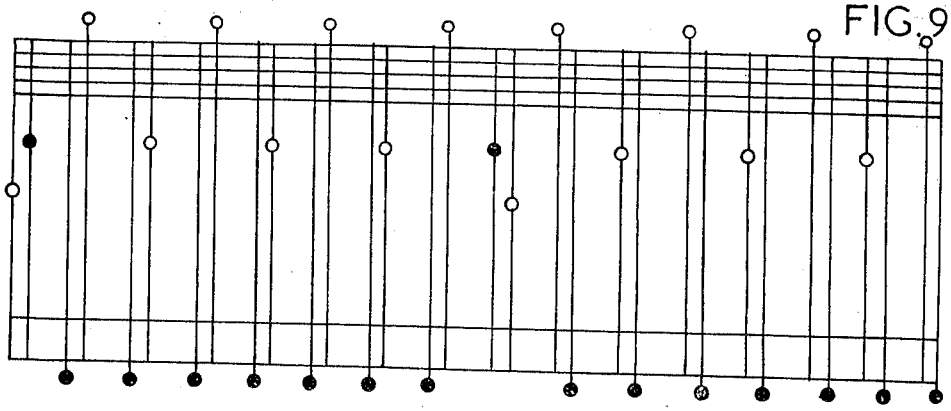
FIG. 9 shows a diagram illustrating the positions of a weft yarn guide (represented in white) and of a fringe sliver shuttle (represented in black) during different phases of operation of the warp knitting machine.
Figure 10:
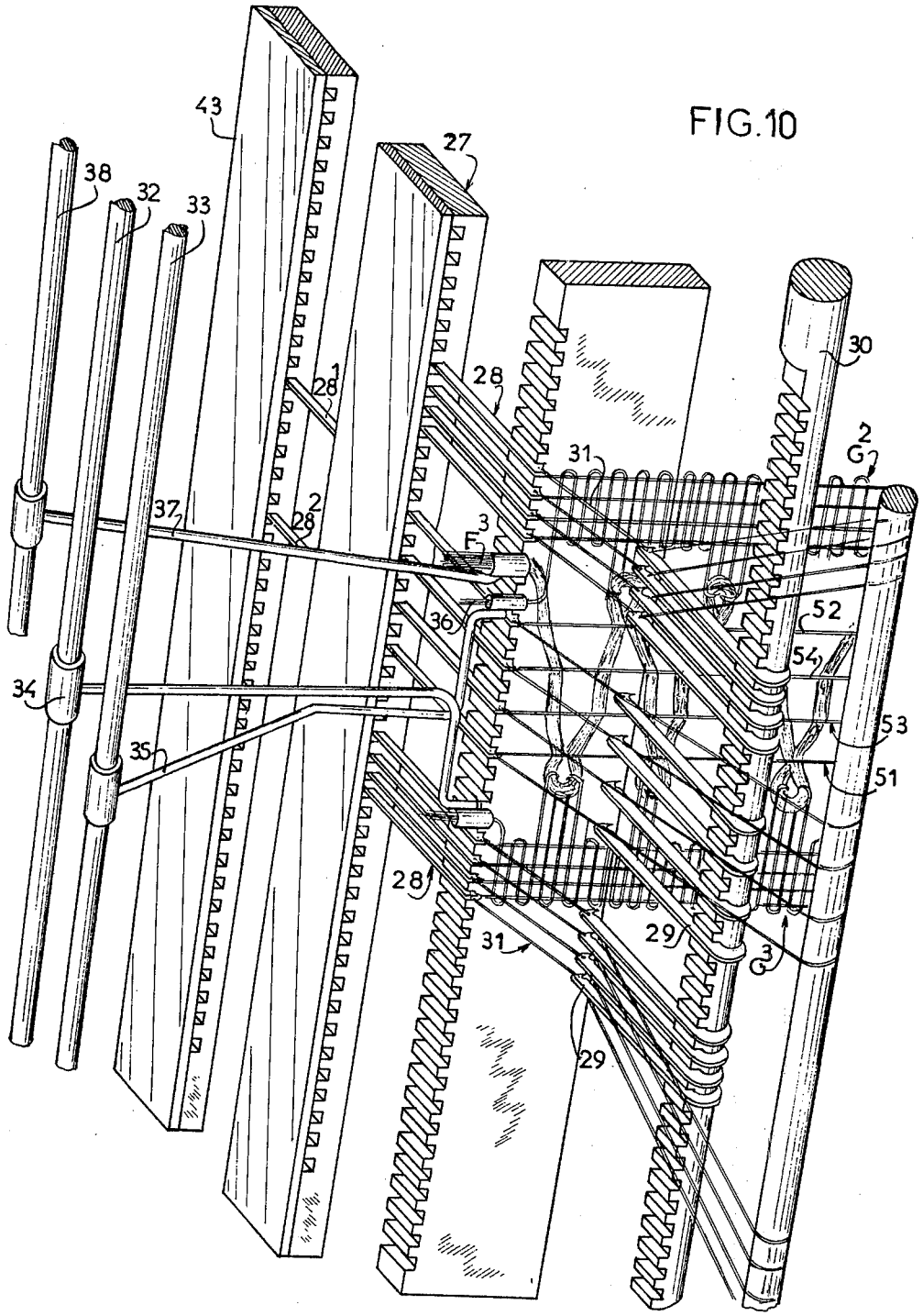
FIG. 10 shows a perspective view of parts of another warp knitting machine for the knitting of two spaced-apart braids connected by a fringe sliver.
Figure 11:
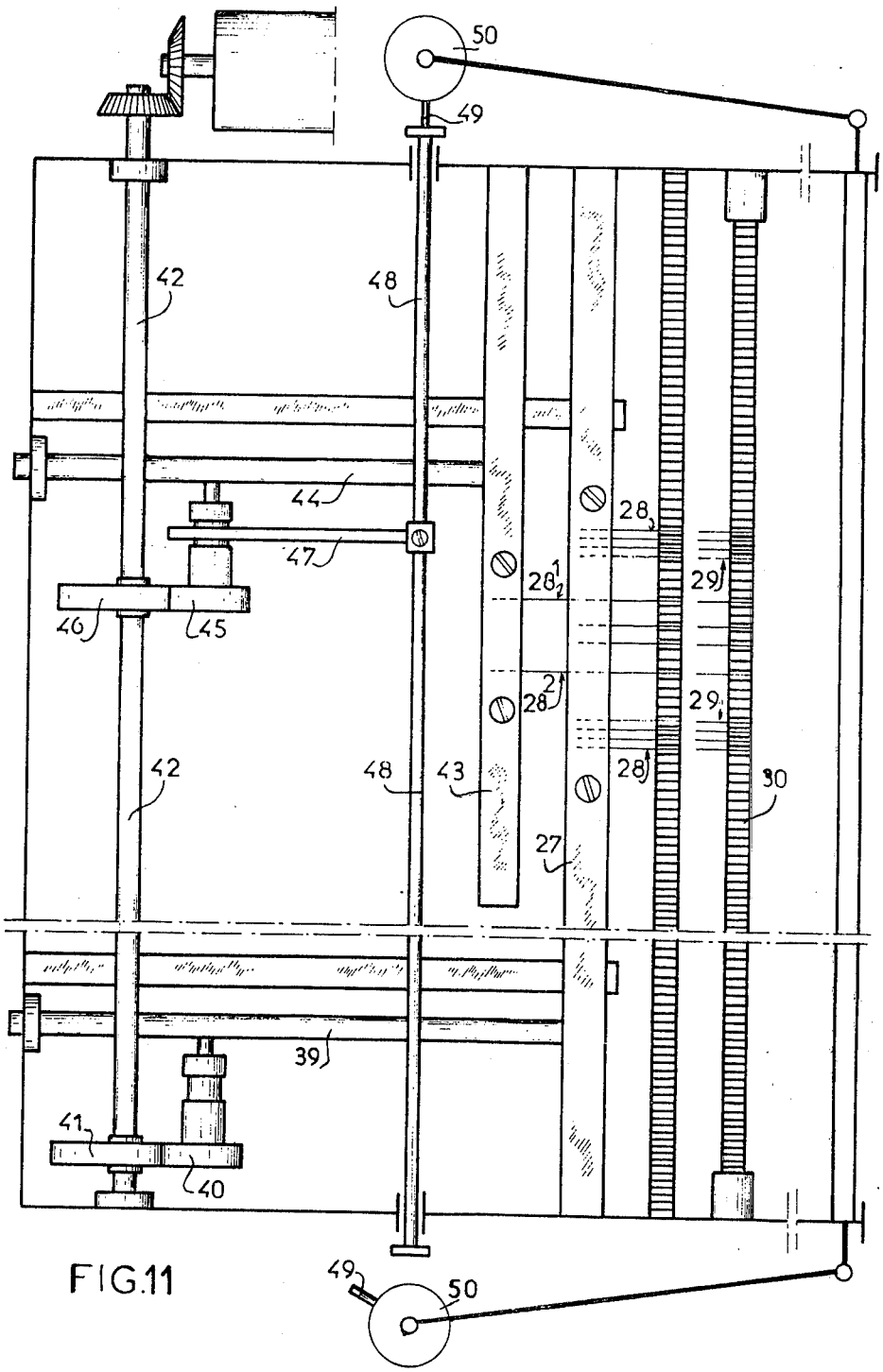
FIG. 11 shows a view of apparatus for disengaging a needle bar of the loom of FIG. 10.

This knitted structure comprising braid G and sliver F has the appearance shown in FIG. 7, with a succession of spaced weftwise projecting loops G$^1$ wherein there are interlooped loops F$^3$ of the sliver F held and connected towards one end by the warp threads 24, 25, while the warp 23 of elastic threads ties the half-loops F$^1$ and F$^2$ near to the loops G$^1$ and also connects them. FIG. 9 illustrates positions of the yarn guide 7 (represented in white) and the sliver guide 8 (represented in black) in successive phases of operation of the warp knitting machine.

Figure 8:
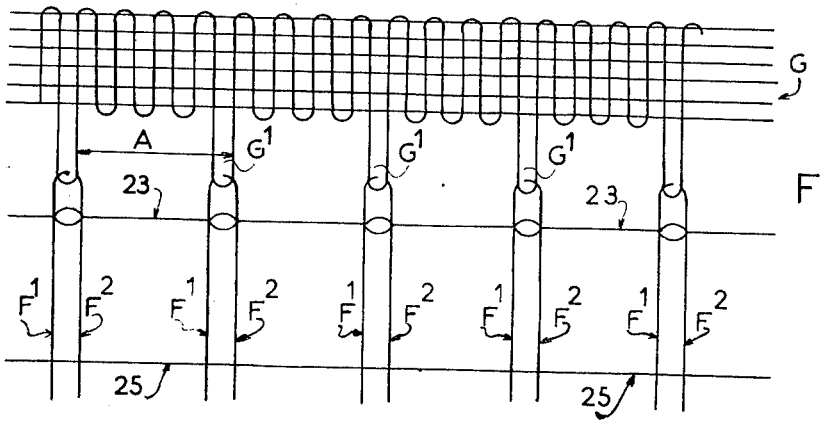
FIG. 8 is a view similar to that of FIG. 7 after portions of the sliver have been removed.

A shears indicated at 26 (see FIG. 7) is arranged at the base of the warp knitting machine and controlled in known manner. The shears 26 severs the sliver F between the warp threads 24 and 25 as the knitted structure passes, thus to produce the structure shown in FIG. 8. It is then simply necessary to release the non-elastic warp thread 25 manually and to cut by hand the elastic warp threads 23 outside the ties.

It will be apparent that this knitted structure can be made in any pattern and that the parts of the machine which have not been described, such as escapement rods, needle beds, banks, warp and weft thread distribution systems, are constructed in known manner.

It is also possible to interloop fringe sliver loops and weft yarn loops at various lengthwise positions of the braid.

For the double production of fringed braids on the same type of warp knitted machine it is necessary to mount on two different carrier rods 32 and 33 two weft yarn guides 34 and 35 receiving continuous weft yarns 36 and 36' respectively. The rods 32 and 33 permit, by weftwise movement thereof, in combination with the movement of a first needle bed 27, the knitting of two spaced-apart braids G$^2$ and G$^3$ having weftwise projecting loops, by the temporary variation in the weftwise movements of the rods 32 and 33 and consequently of the shuttles 34 and 35.

A fringe sliver guide 37 receiving a ropelike fringe sliver F$^3$ is fast with another carrier rod 38 arranged at the rear of the rods 32 and 33, the rod 38 being movable weftwise and being oscillatable so as to rock the guide 37 about the axis of the rod 38.

Reciprocation of the needle bar 27 is effected by a control rod 39 carrying a follower wheel 40 which co-operates with a rotary cam 41 mounted on a drive shaft 42.

A second needle bar 43 is disposed behind the first needle bar 27 and is disengageable to permit the bar 43 to be stopped. The needle bar 43 has fixed thereto the heels of long needles 28$^1$ and 28$^2$ which correspond to elastic tying threads, the needles 28$^1$ and 28$^2$ engaging freely in the first needle bar 27, which is not disengageable. The second needle bar 43 can be reciprocated by means of a control rod 44 carrying a follower wheel 45 which co-operates with a rotary cam 46 mounted on the drive shaft 42. The follower wheel 45 is adapted to be moved weftwise, for disengagement from the rotary cam 46, by means of a forked rod 47 fast with a disengaging bar 48 longitudinally reciprocable by dogs 49 of drums 50.

This arrangement thus makes it possible, by disengagement of the wheel 45 from the cam 46, to temporarily stop the driving of the needle bar 43 and consequently the reciprocating movement of the needles $28^1$ and $28^2$.

It should also be noted that the two guides 34 and 35 are offset weftwise relatively to one another and are displaced respectively in weftwise movement for the formation of the two braids $G^2$ and $G^3$, whereas the rocking movement of the guide 37 permits the passage of the guide 37 past the guides 34 and 35 at the front or the rear side thereof.

There will now be described various phases in the operation of the warp knitting machine for the double production of fringed braids.

FIGS. 12 to 15 show four main phases regarding the formation of the right-hand braid $G^2$ with weftwise projecting loops, and the interlooping of the sliver $F^3$ therewith. It will be apparent that these phases are repeated in relation to the left-hand braid $G^3$ in an identical manner.

The weft yarns 36 and 36' are given weftwise movements by the guides 34 and 35 respectively in combination with the reciprocating movement of the needle bar 27, carrying neeldes 28, and in accordance with the width of the braid, to permit knitting in usual manner, with closed-up or scalloped edges.

This knitting operation is accompanied, by means of the needles $28^1$ and $28^2$ co-operating with hooks 29 mounted on a bar 30, by the formation by knitting of two small warps 51 and 52 of elastic threads, offset inwardly relatively to the two braids $G^2$ and $G^3$, the warps 51 and 52 being disposed in the region of the weftwise projecting loops of the braids $G^2$ and $G^3$, and arranged to connect and grip part-loops $F^4$ and $F^5$ of the sliver $F^3$. In the same way two other small warps 53 and 54 of non-elastic threads are woven, between the warp threads 51 and 52, to connect the part-loops $F^4$ and $F^5$ and to hold the woven assembly disposed between the braids $G^2$ and $G^3$.

In a first phase (see FIG. 12) the guide 35 is displaced weftwise over a considerable length L, corresponding to the length of a weftwise projecting loop $G^4$ to bring the weft yarn 36' into an end position, whereas the guide 37 guiding the sliver $F^3$ is moved weftwise past the guide 35.

Figure 13:
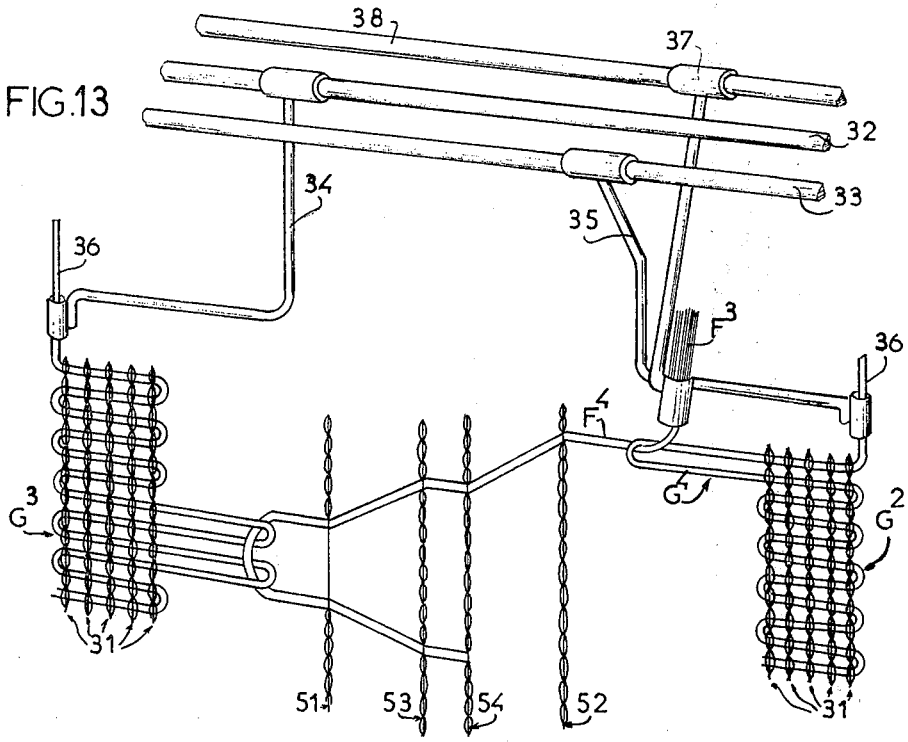

Before the second phase of operation, as shown in FIG. 13, the guide 37 rocks forwards (but is in the same position in the weftwise sense as for the first phase) to allow the guide 35 to pass to the rear of the guide 37. By a weftwise return movement of the carrier rod 33, the shuttle 35 is made to close the loop $G^4$ and grip the run $F^4$ of the sliver $F^3$.

Figure 14:
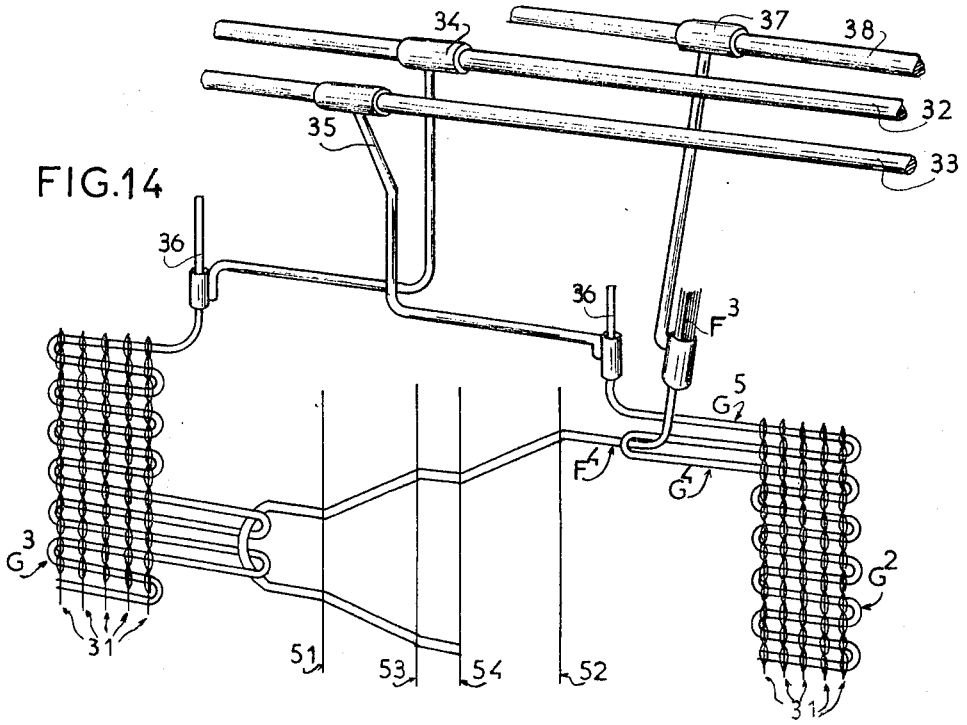

In a third phase, shown in FIG. 14, the guide 37 remains angularly offset in the same position as FIG. 13, and the guide 35 returns into the first phase position, therefore passing behind the run $F^4$.

Figure 12:
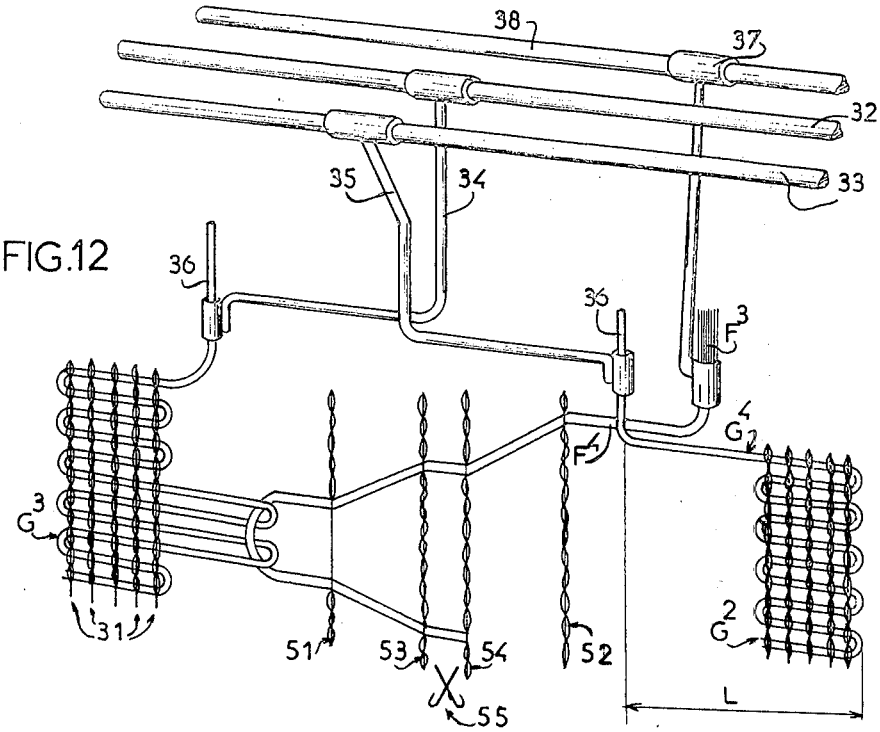
FIGS. 12 and 15 show views illustrating respective phases in the formation of the two braids on the warp knitting machine of FIG. 10.
Figure 15:
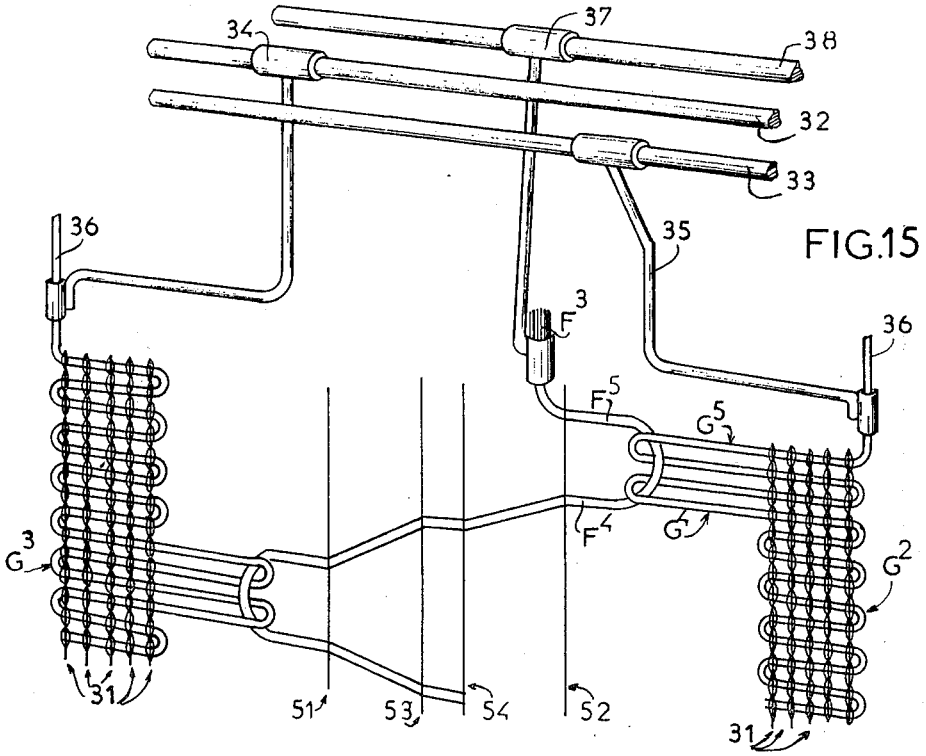

Before commencement of the fourth phase, shown in FIG. 15, the guide 37 rocks rearwards, to the angular position as indicated in FIG. 12, for the passage of the guide 37 at the front side of the guide 35, thereby to close a second loop $G^5$ interlooped with a loop of the sliver $F^3$ comprised of part-loops $F^4$ and $F^5$. It will be noted that in this fourth phase the guide 37 is displaced weftwise slightly towards the left so that the needle of the elastic tying thread 52 can grip the sliver $F^3$. Furthermore, at the end of the fourth phase the needles $28^1$ and $28^2$ of the elastic tying threads remain out so as to grip the two part-loops $F^4$ and $F^5$ of the sliver $F^3$, the follower wheel 45 being in its disengaged position consequently momentarily stopping the second needle bar 43. It should be noted that the needles 28 are never stopped.

It should also be noted that during the formation of the loops $G^4$ and $G^5$ of the right-hand braid $G^2$, the guide 34 knits the left-hand braid $G^3$ normally.

When these four main phases relating to the right-hand braid $G^2$ are completed, the guide 37 supporting the sliver $F^3$ is displaced weftwise to the left, passing to the rear of the guides 34 and 35. There are then identical phases of operation relating to the left-hand braid $G^3$.

A cutting shears, indicated at 55 in FIG. 12, is mounted at the base of the warp knitting machine and controlled in known manner, severs the sliver $F^3$ between threads 53 and 54 as the woven structure passes.

On obtaining the two opposite braids $G^2$ and $G^3$ with their fringes, it is sufficient to release by hand the non-elastic warp threads 53 and 54 and to cut by hand the elastic warp threads 51 and 52 outside the ties, to produce the final articles.

It will be apparent that this knitting can be effected with any pattern and that the parts of this warp knitting machine which have not been described, such as escapement rods, needle beds, banks, warp and weft thread distribution systems, are constructed in known manner.

Furthermore, it is possible to interloop fringe sliver loops with weft yarn loops at various lenthwise positions of the braids and the number of loops of the braids interlooped with each sliver loop can be varied.

It should also be borne in mind that in the event that the fringe sliver is of considerable thickness, the needles relating to the non-elastic warp threads 53 and 54 can engage freely in the first needle bar 27 and be fixed at their rear ends on the second needle bar 43, and as a result stopped at the time the needle bar 43 is disengaged.

I claim:

1. A method for continuous production of a fringed textile article comprised of a braid formed at intervals with weftwise projecting loops holding a fringe, comprising knitting a continuous weft yarn with warp to form said braid, periodically halting the knitting of the weft yarn with the warp while displacing a weft yarn guide weftwise from said braid to form a weftwise projecting part-loop of said continuous weft yarn, displacing towards said braid a fringe sliver guide to form a weftwise part-loop of a fringe sliver, displacing the guides relative to each other to displace one of the guides from one side of the other guide to the opposite side of said other guide to interloop the part-loops, returning said weft yarn guide weftwise to said braid to complete a projection loop of said continuous wefty yarn, resuming said knitting, returning said fringe sliver guide weftwise away from said braid to complete a loop of said fringe sliver, interconnecting the part-loops of said fringe sliver with first and second warp threads spaced apart weftwise, and severing the part-loops of said fringe sliver between said first and second warp threads to provide tassels forming said fringe.

2. A method according to claim 1, wherein said first warp thread is an elastic warp thread which extends close to said weftwise projecting loops.

3. A method according to claim 1, wherein said first and second warp threads are non-elastic warp threads which extend at a relatively small spacing from each other but at a relatively large spacing from said weftwise projecting loops.

4. A method according to claim 1, and further comprising, intermediate said resuming and said returning of said fringe sliver guide, again displacing said weft yarn guide weftwise from said braid to form a further weftwise projecting part-loop of said continuous weft yarn, and displacing the guides relative to each other to interloop said further weftwise projecting part-loop of said continuous weft yarn and said part-loop of said fringe sliver.

5. A method according to claim 1, and further comprising knitting another continuous weft yarn with other warp to form another braid displacing another weft yarn guide weftwise from said other braid and towards the first-mentioned braid to form a weftwise projecting partloop of said other continuous weft yarn, periodically halting the knitting of said another weft yarn with said other warp while displacing towards said other braid and away from the first-mentioned braid said fringe sliver guide to form a further weftwise part-loop of said fringe sliver, displacing said other weft yarn guide and fringe sliver guide relative to each other to displace one of said other weft yarn guide and said fringe sliver guide from one side of the other of said other weft yarn guide and said fringe sliver guide to the opposite side thereof to interloop said weftwise projecting part-loop of said other continuous weft yarn and said further weftwise part-loop of said fringe sliver, returning said other weft yarn guide weftwise to said other braid to complete a projecting loop of said other continuous weft yarn, resuming the knitting of said other continuous weft yarn with said other warp, returning said fringe sliver guide weftwise away from said other braid to complete a further loop of said fringe sliver, and interconnecting the part-loops of said further loop of said fringe sliver with third and fourth warp threads spaced apart weftwise.

6. A method according to claim 5, wherein the third warp thread is an elastic warp thread which extends close to said projecting loop of said other continuous weft yarn.

7. A method according to claim 5, wherein the fourth warp thread is a non-elastic warp thread which extends closer to one of said first and second warp threads than to said projecting loop of said other continuous weft yarn.

8. A method according to claim 5, wherein during the interlooping of the part-loops of the first-mentioned continuous weft yarn with part-loops of said fringe sliver there is continued the knitting of said other continuous weft yarn with said other warp, and during the interlooping of the part-loops of said other continuous weft yarn with part-loops of said fringe sliver there is continued the knitting of said first-mentioned continuous weft yarn with the first-mentioned warp.

9. Apparatus for the continuous production of a fringed textile article comprised of a braid formed at intervals with weftwise projecting loops holding tassels forming a fringe, comprising a weft yarn guide for guiding a continuous weft yarn which is knitted with warp to form said braid, means for periodically reciprocating said weft yarn guide weftwise to form said weftwise projecting loops, from the same weft yarn forming said braid, a fringe sliver guide for guiding a fringe sliver, means for reciprocating said fringe sliver guide weftwise to form weftwise loops of said fringe sliver, displacing means for displacing the guides relative to each other to displace one of the guides from one side of the other guide to the opposite side of said other guide to produce said weftwise projecting loops and said loops of said fringe sliver in a condition with said weftwise projecting loops interlooped with said loops of said fringe sliver, means for interconnecting the halves of said loops of said fringe sliver with first and second warp threads spaced apart weftwise including means for encircling the halves of the loops with one of said warp threads to tie the loops, said one warp thread being elastic, a needle bar for holding needles for operation in the knitting of said continuous weft yarn with said warp and in the interconnecting of said halves of said loops of said fringe sliver with said first and second warp threads, reciprocating means for reciprocating said needle bar transversely with respect to both the warp and the weft, and disengaging means operable to prevent said reciprocating means from reciprocating said needle bar during the operation of said displacing means.

10. Apparatus according to claim 9, wherein said reciprocating means comprises cam means, and follower means attached to said needle bar and co-operable with said cam means, and said disengaging means comprises further cam means and a disengaging member arranged to be reciprocated by said further cam means, and, in being so reciprocated, to move said follower means into and out of co-operation with the first-mentioned cam means.

11. Apparatus according to claim 9, wherein said means for reciprocating said weft yarn guide weftwise comprises a weftwise extending carrier rod, to which said weft yarn guide is attached, and cam means for reciprocating said carrier rod lengthwise thereof.

12. Apparatus according to claim 9, wherein said means for reciprocating said fringe sliver guide weftwise comprises a weftwise extending carrier rod, to which said fringe sliver guide is attached, and cam means for reciprocating said carrier rod lengthwise thereof, and said displacing means comprises rocking means for rocking said fringe sliver guide about the longitudinal axis of said carrier rod.

13. Apparatus according to claim 12, wherein said rocking means comprises a rocking arm attached to said carrier rod, another cam means operable to rock said rocking arm so as to turn said carrier rod about said axis, ratchet means for turning said other cam means, and further cam means linked to said ratchet means for driving the first-mentioned cam means.

14. Apparatus according to claim 9, and further comprising severing means for severing said halves of said loops of said fringe sliver intermediate said first and second warp threads.

15. Apparatus for the continuous production of a fringed textile article comprised of a braid formed at intervals with weftwise projecting loops holding tassels forming a fringe, comprising a weft yarn guide for a continuous weft yarn which is knitted with warp to form said braid, means for periodically reciprocating said weft yarn guide weftwise to form said weftwise projecting loops from the same weft yarn forming said braid, a fringe sliver guide for guiding a fringe sliver, means for reciprocating said fringe sliver guide weftwise to form weftwise loops of said fringe sliver, displacing means for displacing the guides relative to each other to displace one of the guides from one side of the other guide to the opposite side of said other guide to produce said weftwise projecting loops and said loops of said fringe sliver in a condition with said weftwise projecting loops interlooped with said loops of said fringe sliver, means for interconnecting the halves of said loops of said fringe sliver with first and second warp threads spaced apart weftwise including means for encircling the halves of the loops with one of said warp threads to tie the loops, said one warp thread being elastic, another weft yarn guide for guiding another continuous weft yarn which is knitted with other warp to form another braid, means for reciprocating said other weft yarn guide weftwise to form weftwise projecting loops of said other continuous weft yarn, means for reciprocating said fringe sliver guide weftwise to form further weftwise loops of said fringe sliver, means for displacing said other weft yarn guide and said fringe sliver guide relative to each other to displace one of said other weft yarn guide and said fringe sliver guide from one side of the other of said other weft yarn guide and said fringe sliver guide to the opposite side thereof to produce said weftwise projecting loops of said other continuous weft yarn and said further loops of said fringe sliver in a condition with said weftwise projecting loops of said other continuous weft yarn interlooped with said other loops of said fringe sliver, means for interconnecting the halves of said further loops of said fringe sliver with third and fourth warp threads spaced apart weftwise, a needle bar for holding needles for operation in the interconnecting of the halves of the first-mentioned loops of said fringe sliver and the halves of said further loops of said fringe sliver with the first and fourth warp threads respectively, reciprocating means for reciprocating said needle bar transversely with respect to both the warp and the weft, and disengaging means operable to prevent said reciporcating means from reciprocating said needle bar during the operation of the means for displacing the first-mentioned weft yarn guide and said fringe sliver guide relative to each other and for displacing said other weft yarn guide and said fringe sliver guide relative to each other.

16. Apparatus according to claim 15, and further comprising another needle bar for holding needles for operation in the knitting of said first-mentioned weft yarn with said first-mentioned warp and in the knitting of said other continuous weft yarn with said other warp, wherein the arrangement is such that, in operation of the apparatus, the needles held by the first-mentioned needle bar extend freely through said other needle bar.

17. Apparatus according to claim 15, wherein said reciprocating means comprises cam means and follower means attached to said needle bar and co-operable with said cam means, and said disengaging means comprises further cam means and a disengaging member arranged to be reciprocated by said further cam means, and, in being so reciprocated, to move said follower means into and out of co-operation with the first-mentioned cam means.

* * * * *